United States Patent [19]

Busby

[11] Patent Number: 4,467,585

[45] Date of Patent: Aug. 28, 1984

[54] METHOD AND APPARATUS FOR CONSTRUCTION SECOND STORY ADDITIONS TO PRE-EXISTING RESIDENTIAL STRUCTURES

[76] Inventor: Richard D. Busby, 3133 E. Onyx, Phoenix, Ariz. 85028

[21] Appl. No.: 381,895

[22] Filed: May 25, 1982

[51] Int. Cl.[3] ..... E04G 23/06

[52] U.S. Cl. ..... 52/741; 52/66; 52/122.1; 52/79.1

[58] Field of Search ..... 52/741, 745, 747, 126.1, 52/126.5, 66, 236.3, 79.1, 79.5, 122.1, 79.9–97.12, 83, 66

[56] References Cited

U.S. PATENT DOCUMENTS

| | | | |
|---|---|---|---|
| 3,600,870 | 8/1971 | Greenhalgh | 52/745 |
| 3,722,171 | 3/1973 | Godley | 52/745 |
| 3,841,040 | 10/1974 | Toulson et al. | 52/741 |
| 4,003,182 | 1/1977 | Wokas | 52/745 |
| 4,138,833 | 2/1979 | Townend | 52/745 |

*Primary Examiner*—J. Karl Bell

*Attorney, Agent, or Firm*—Cahill, Sutton & Thomas

[57] ABSTRACT

A second story addition is provided on a pre-existing residence by severing straps connecting trusses of a first portion of the original roof of the structure covering a first section of the residence on which the second story room is to be added. The first roof section also is severed from the remaining portion of the roof. Roof lifting brackets are temporarily installed under the truss chords to support all of the trusses and are engaged by eyelet bolts which extend through the top of the first roof section. Cables support by a large crane are attached to the eyelet bolts, and the crane lifts the first roof section, including a ceiling attached to the bottom of its trusses, from the first section of the residence and sets the first roof section on the ground. Cables supported by the crane then engage eyelet bolts attached to a pre-constructed floor section. The crane lifts the floor section, aligns it with the first section of the residence, and sets it thereon. The crane is then operated to position pre-constructed wall sections on the installed floor section. The crane then lifts the first roof and places it on the installed wall sections.

6 Claims, 14 Drawing Figures

9
55
23
37B
37A
37E'
5
37C
39B
41
39A
37D
29
43
37E
41A
41B
41D
41E
41C
43E
43D
45
47A
47B
47C
54
50
49A
49
51
4

METHOD AND APPARATUS FOR CONSTRUCTION SECOND STORY ADDITIONS TO PRE-EXISTING RESIDENTIAL STRUCTURES

BACKGROUND OF THE INVENTION

The invention relates to apparatus and methods for remodeling pre-existing buildings, and more particularly, to methods for adding upper story rooms to pre-existing residences.

The cost of new homes has skyrocketed within the past decade, and the very high interest rates that have prevailed for mortgage loans in recent years have put the average total monthly payment for a new home far higher than is affordable by the vast majority of American families. Yet, the amount of room needed by many families in order to live comfortably as their families grow has continued to increase. Therefore, increasing numbers of home owners now opt to add rooms to their present residences, since they can not afford the high mortgage payments that would result if they were to purchase a larger home which they would have to refinance.

In many cases, adding one or two rooms or "wings" onto a typical single story residence is a relatively simple matter, and the cost of financing such an addition at prevailing interest rates can be much more easily afforded by a typical family than financing of a larger house having the same liveable area as their present house with a new room addition.

Unfortunately, many single story residences are so situated on lots that it is impractical to add a ground level room addition because of the presence of fences, zoning restrictions, or other problems. In such situations, the only choice available is to add one or more second story rooms to the residence. Using conventional building techniques, the addition of a second story room addition is a much more complex and expensive task than adding of a comparable size ground level room. Typically, addition of a second story room requires piece-by-piece removal of the original roof covering the portion of the residence to which the second story room is to be added. This is an operation in which is both time consuming and wasteful of the materials of which the removed roof portion is constructed. Furthermore, the interior of the residence is exposed to any bad weather that may unexpectedly occur until the "shell" of the new second story room addition is complete. The new floor of the second story room addition typically is constructed by carrying large beams and floor joists, piece-by-piece, up ladders and positioning them to span the exposed portion of the residence. Floor boards or plywood sheets then also are lifted, piece-by-piece, up to the site of the second story room addition and are fastened on top of the joists which, to some extent, protect the underlying ceiling of the residence. However, the floor is not waterproof and any significant amount of rain would cause leakage that would stain and otherwise damage the underlying ceiling and adjacent walls. Next, wall studs typically are erected, again on a piece-by-piece basis, forming the basic structure for the outer walls of the second story room addition. Next, preassembled trusses are delivered to the building site and are hand carried up to the top of the second story structure and are positioned on the installed basic wall sections and are fastened thereto. Next, roof sheathing is provided, and finally roofing, such as shingles, is attached to the outer surface of the sheathing. Normally, siding boards or sheets are installed on a piece-by-piece basis. Ceiling panels are attached to the bottoms of the trusses forming the new roof section, and insulation is installed in the attic space. This entire construction process may require the interior of the residence to be exposed or partially exposed to the effects of bad weather for quite a number of days, and the additional labor required because of the necessity of transporting the material to the second story working site, and also time wasted as workers repeatedly climb up and down ladders, means that a great deal of added expense and inconvenience occurs when it is necessary to make a second story addition to a pre-existing residence.

Although prefabricated buildings of various types are well known, wherein preconstructed floor, wall, and roof sections of modular buildings are all transported to a preconstructed foundation, whereat a crane is utilized to position the preconstructed floor, wall, and roof structures, these techniques have never been applied to remodeling pre-existing single story residences, which themselves usually have been constructed using conventional piece-by-piece building techniques. Apparently, it has been believed that prefabricated second story wall, floor and roof structures can not be conveniently matched to such structures in a practical manner, and for good reason: most preexisting residences are not modular or standardized in structure. Therefore, room additions usually need to be custom tailored to meet the different individual needs of each residence that is to be enlarged by adding a second story thereto. Accordingly, conventional piece-by-piece construction techniques have been widely, perhaps universally, used in the upper story room addition art.

U.S. Pat. Nos. 3,722,171; 3,600,870; 4,012,871; 4,272,930; and 3,964,218 are believed to be illustrative of the state of the art for prefabricated building construction techniques. However, none of the above references disclose or suggest techniques that have in the past been found to be well suited to making second story additions thereto.

Accordingly, there appears to be a great unmet need for a method and associated apparatus for economically and conveniently adding second story rooms to preexisting buildings, especially preexisting residences.

Accordingly, it is an object of this invention to provide a low cost method and apparatus for conveniently adding second story room additions to preexisting structures, especially preexisting residential structures.

It is another object of the invention to provide an improved method and apparatus for conveniently making second story room additions to preexisting residential structures without requiring the construction of an entire new roof to cover the second story room additions.

It is another object of the invention to provide an improved method and associated apparatus that permits relatively rapid construction of a second story room addition on a building to minimize the exposure of interior portions of the building to possible bad weather during construction.

It is another object of the invention to provide an improved method and apparatus for constructing second story room additions to preexisting structures to minimize the amount of labor and building material required to construct such room additions.

SUMMARY OF THE INVENTION

Briefly described, and in accordance with one embodiment thereof, the invention provides an apparatus and method for rapidly installing a second story room addition onto a first portion of a preexisting building structure, such as a residence, by initially constructing a second story floor section and preconstructing second story wall sections at ground level at the location of the residence, severing a first section of the original roof covering the first portion of the residence from the remaining portion of the roof and also severing and/or removing the means (such as metal straps) attaching the first roof section to the supporting walls of the first portion of the residence, installing interior truss supporting apparatus and also eyelet bolts attached thereto at a plurality of lift points of the first section, attaching crane cables to the eyelet bolts, and operating the crane to lift the first roof section from the residence and set it on the ground adjacent to the residence. The cables supported by the crane are then attached to eyelet bolts that are connected to joist supports connected to the under side of the preconstructed floor section. The crane then is operated to lift the floor section, align it with, and finally set it on the walls of the first section of the residence. The crane is then operated to lift the preconstructed wall sections and then position them peripherally on the installed floor section to partially enclose the second story room addition. The wall sections then are rigidly attached to the floor section and to each other. The crane is then utilized to again lift the first roof section by means of the cables, truss lifting apparatus, and eyelet bolts, and then to align the first roof section with the upper edges of the installed wall sections and place the first roof section thereon. An overhang roof section, also initially constructed on the ground beside the residence, is lifted by the crane and attached to the first roof section where it was originally severed from the remainder of the original residence roof, and is fastened in aligned relationship to the reinstalled first roof section.

In one described embodiment of the invention, wherein the preexisting first roof section would be unsuitable for the second story room addition, that section is simply removed by the most expedient means, and an entire preconstructed roof section is constructed at ground level adjacent to the residence, and after the second story floor and wall sections have been installed, the preconstructed new roof section is positioned on top of the walls of the partially installed second story room addition by means of the crane.

In the described embodiment of the invention, an elongated roof peak support spanner having spaced precut slots therein is aligned under peak portion along the points at which the top truss chords join. The opposed sides or leaves of U-shaped nailing strap plates are inserted through respective pairs of the slots to provide nailing tabs, with nail holes therein which extend above the spanner, which are nailed to the top truss chords to support the peak spanner. The spanner member extends nearly the entire length of the peak portion of the first roof section, and is sufficiently rigid to provide adequate support to every truss as the first roof section is being lifted by the crane. Holes are drilled through the peak of the roof and aligned with holes in the peak spanner and eyelet bolts having eyelets above the peak of the first roof section have threaded lower ends that extend through corresponding holes in the peak support member, and engage nuts on the underside of the peak spanner to support it. At at least several edge portions of the first roof section, additional spanners are attached to the underside of a plurality of truss chords and also are attached to eyelet bolts that extend through lift points of the first roof section. Cables and cable length adjustment devices ("come-alongs") connect the latter eyelets to a horizontal hoist bar of the crane and are adjusted to prevent tilting of the first roof section as it is lifted away from the first portion of the residence. The floor section supporting elements in the described embodiment of the invention consists of spanners which each support at least three floor joists of the floor section and engage eyelet bolts that extend through predrilled holes located at the lift points of the floor section. The described embodiment of the invention allows the original roof covering the first portion of the building to be removed, the new floor section to be installed, the preconstructed wall sections to be installed, and the first roof section to be reinstalled on the new wall sections, and an overhang roof section all to be installed by means of a crane and a small crew of workers in less than one working day and with a high degree of safety and avoidance of any damage to the outer portions of the residence. The long construction time, waste of the material of which the original roof is constructed, and the excessive labor of piece-by-piece construction at elevated levels are avoided by the above described embodiments of the invention.

DESCRIPTION OF THE INVENTION

Figure 1B:
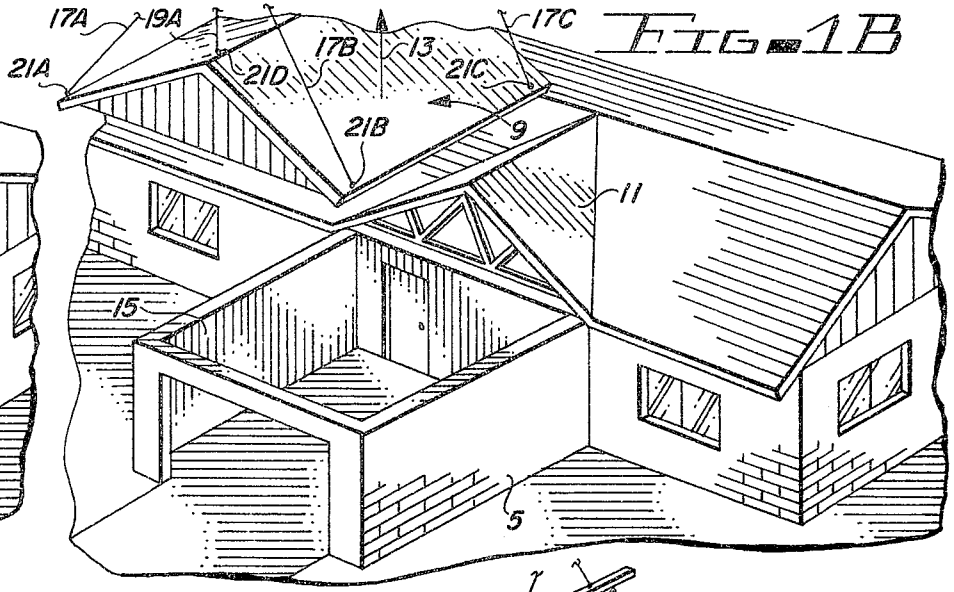
FIG. 1B illustrates removal of the garage roof of the residence shown in FIG. 1A.
Figure 1C:
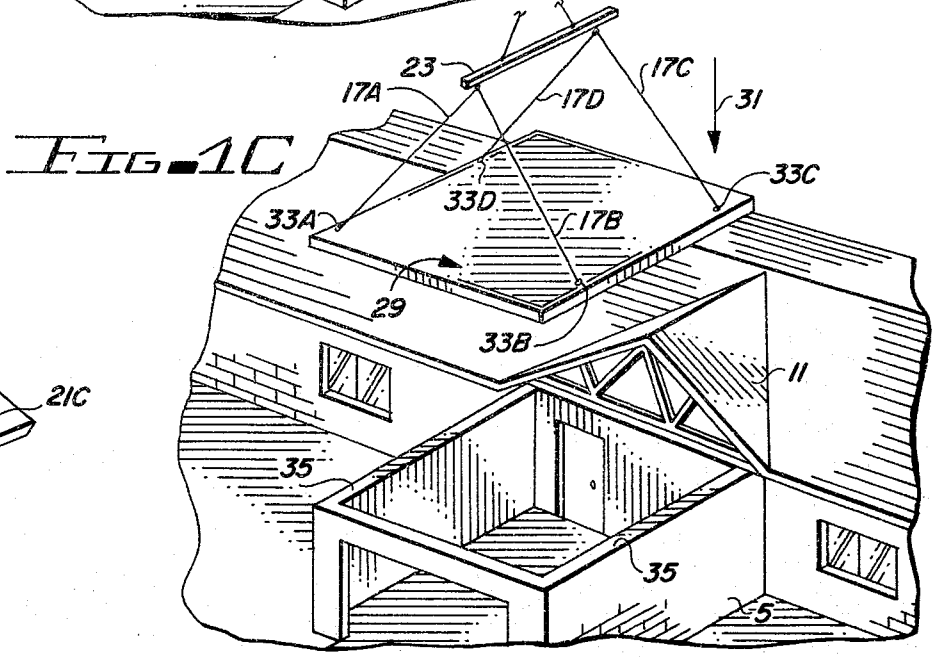
FIG. 1C illustrates the operation of positioning a preconstructed floor section for the second story room addition being made to the residence of FIG. 1A.
Figure 1A:
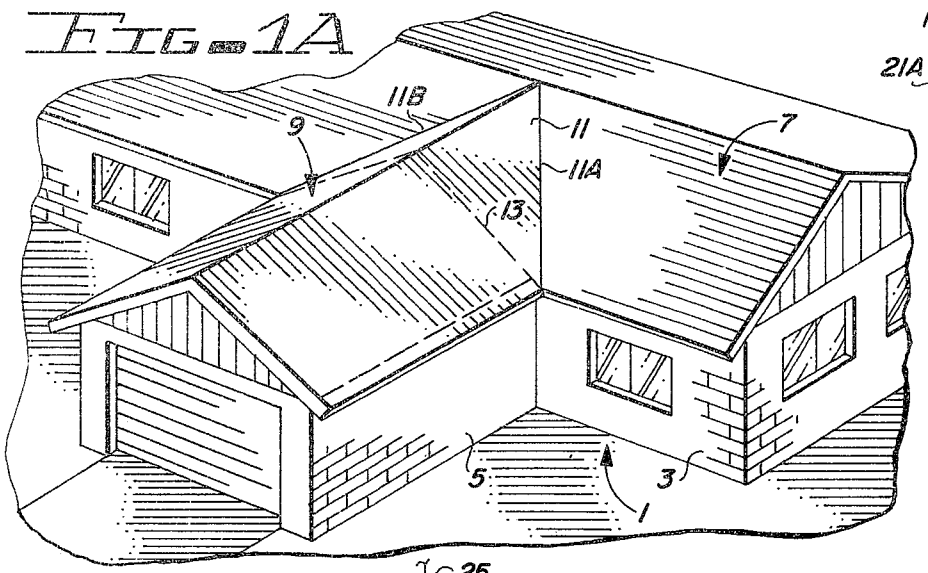
FIG. 1A is a partial perspective view of a single story residence on which a second story room addition is to be made in accordance with the present invention.

Referring now to the drawings, particularly FIG. 1A, residence 1 has a living section 3 and a garage 5. In accordance with the present invention, it is desired to add a second story room addition above garage 5. In order to accomplish this, the garage roof 9 is severed from section 11 of the main residence roof 7 along dotted line 13. The cut along dotted line 13 can be made by means of a conventional circular saw.

Garage roof 9 also must be severed from the walls of garage 5. Typically, the trusses of a roof section, such as garage roof 9 are attached to the supporting walls by means of nails or metal straps that are nailed to the trusses and also to the upper portions of the walls or beams attached thereto. Various common tools can be used for breaking such connections. For example, toe nails can be pulled by means of any of a variety of pulling tools. The above mentioned metal straps can be severed by means of certain kinds of power hack saws or reciprocating saws or the like.

Figure 2:
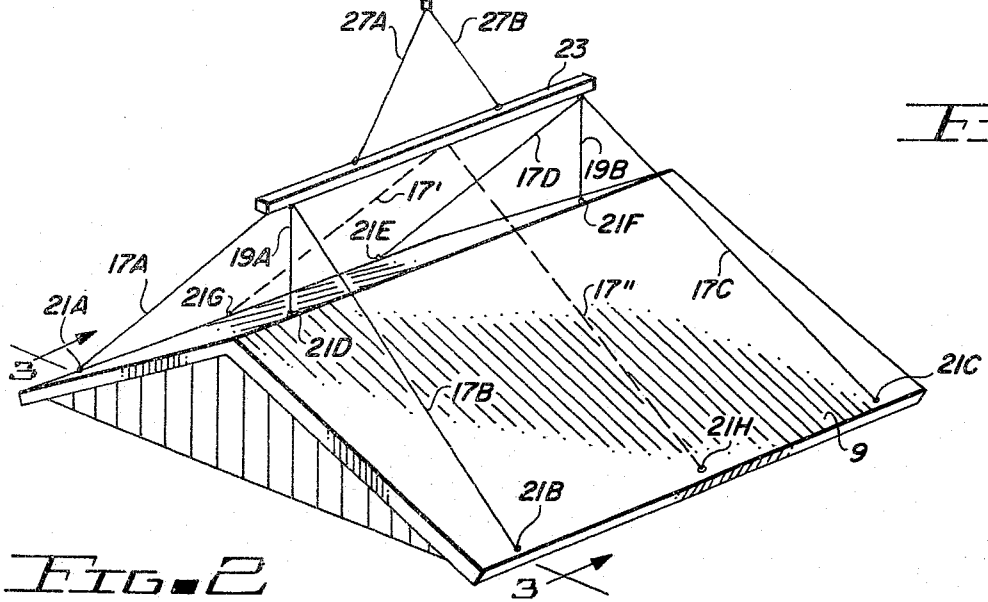
FIG. 2 illustrates the roof lifting elements and crane cables used in removing the garage roof section as shown in FIG. 1B.

In accordance with the present invention, roof lifting eyelet bolts are installed on garage roof 9 at points 21A, 21B, 21C, 21D, 21E, and 21F, as shown in FIG. 2, and crane cables having their upper ends connected to a hoist bar 23 have end hooks that engage the eyelets of the various eyelet bolts. Hoist bar 23 is then lifted by means of two cables 27A and 27B that are joined to a crane cable 25, which lifts garage roof 9 off of garage 5. Common tensioning devices known as "come-alongs" are used to carefully adjust the lengths of each of the cables so that garage roof 9 is maintained level during the lifting operations.

Figures 1D, 1E, 3, 5, 6:
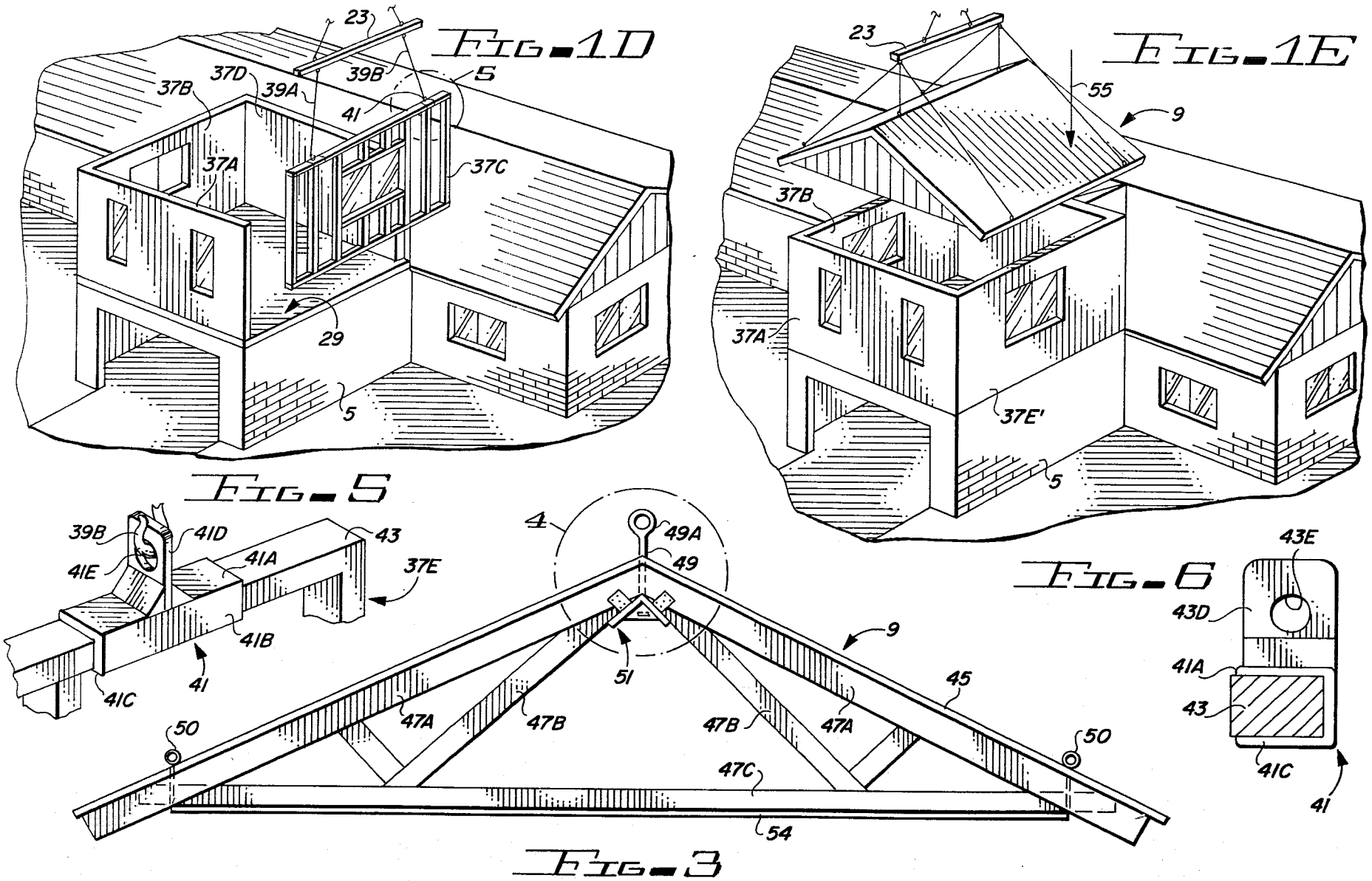
FIG. 1D is a partial perspective diagram illustrating use of a crane to install preconstructed wall sections with the second story roof addition on the building of FIG. 1A.
FIG. 1E is a partial perspective view illustrating use of a crane to place the original garage roof section (removed in accordance with FIG. 1B) on top of the new walls of the second story room addition being made to the residence of FIG. 1B.
FIG. 3 is a section view taken along section line 3—3 of FIG. 2.
FIG. 5 is an enlarged view of detail 5 of FIG. 1D.
FIG. 6 is an enlarged view of the wall lifting clamp shown in FIG. 5.
Figure 7:
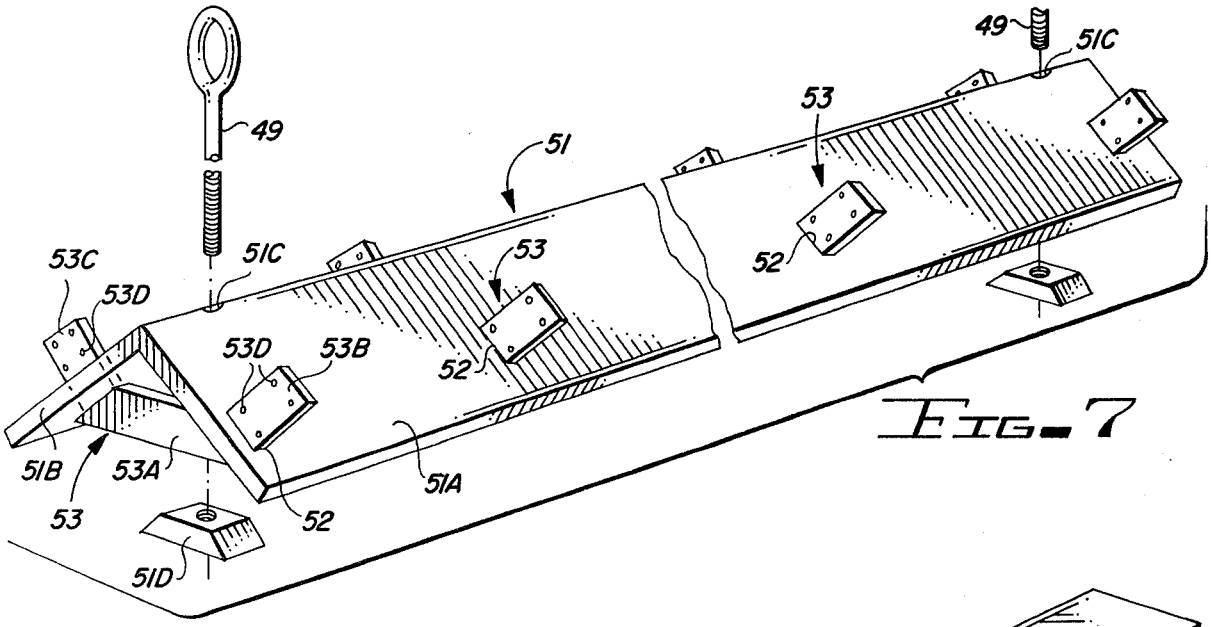
FIG. 7 is a partial perspective view of a peak roof support spanner useful in lifting a roof section as shown in FIGS. 1B and 1E.

Before further discussing the removal of garage roof 9 from garage 5, it will be helpful to first refer to FIG. 3, which illustrates the "peak spanners" which must be installed inside garage roof 9 in order for the cables 17A, 17B, 17C, 17D, 19A, and 19B to uniformly apply upward forces to the abovementioned eyelet bolts as garage roof 9 is lifted. As indicated in FIG. 3, the peak portions of the top truss chords of garage roof 9 are supported by an inverted V-shaped peak spanner 51, which is shown in more detail in FIG. 7. Referring to both FIG. 3 and FIG. 7, peak support spanner 51 includes an inverted V-shaped member including an elongated plate 51A joined to an elongated plate 51B. The angle between plates 51A and 51B (FIG. 7) matches the angle between web cords 47B in the truss shown in FIG. 3. A plurality of slots such as 52, spaced at eight inch intervals, are provided in both plates 51A and 51B. The eight inch slot intervals match either the common sixteen inch or twenty-four inch center-to-center spacings of trusses of garage roof 9. A plurality of U-shaped brackets or straps such as 53 extend from the bottom of roof peak support 51 through the respective slots. Each of the brackets 53 includes a bottom section 53 and two upwardly oriented "leaves" 53B and 53C, which extend through a pair of slots 52. Each of the "leaves" such as 53B and 53C includes a plurality of nailing holes such as 53D. FIG. 3 best illustrates how the bracket 53-C supports peak spanner 51. As shown in FIG. 3, the leaves 53B each are nailed to the top truss chords such as 47A of each truss supported by roof peak spanner 51.

Two holes 51C (FIG. 7) are disposed through the peak portion of spanner 51 at the peak portion thereof. Two threaded eyelet bolts 49 extend downward through the respective holes 51C and through a plate or nut block 51D. Nut block 51D has sloped opposed end surfaces that mate with the slopes of plates 51A and 51D of peak spanner 51. (Preferably, nut block 51D is threaded to receive the threads of eyelets 49, although the hole in nut block 51D could be a clearance hole, in which case a threaded nut would have to be provided at the bottom surface thereof.)

It can be seen that peak spanner 51, installed as shown in FIG. 3, helps to provide uniform distribution of the lifting force to all of the trusses of garage roof 9, thereby preventing any of the trusses from "falling" and causing weakening or partial collapse of roof 9 during the described lifting operations.

Preferably, double headed nails are used in nail holes 53D of the brackets 53 in order to allow the brackets and spanner 51 to be easily removed after the room addition "shell" has been completely installed.

Referring now to FIG. 1B, after the above-mentioned cables are connected to the various eyelet bolts in the manner shown in FIG. 2, the crane gradually applies a suitable upward lifting force on cable 25 (FIG. 2). This upward force is distributed among the various cables shown in FIG. 2 as previously explained. As the crane increases its upward lifting force, the garage roof 9 gradually moves upward in the direction indicated by arrow 13 in FIG. 1B. Several suitably positioned workers (not shown) can help to guide garage roof 9 upward to avoid undesired swinging thereof and scraping against the remaining portion of residence roof 7, as necessary.

Garage roof 9 may have a ceiling 54 (FIG. 3) attached thereto at the bottom end surfaces of each of the horizontal truss chords 47C, and the interior 15 of garage 5 is exposed when roof 9 is removed. The crane then laterally swings roof 9 away from the garage walls and sets roof 9 down on the adjacent ground.

Next, the various cables shown in FIG. 3 are disengaged from the various eyelet bolts, and the cables shown in FIG. 1C are attached to eyelets installed in a unitary preconstructed floor section 29, which is to be placed on the upper edges 35 of the walls of garage 5. Floor section 29 has been preconstructed on temporary blocks or pieces at ground level before the above described removal of garage roof 9.

Figure 4:
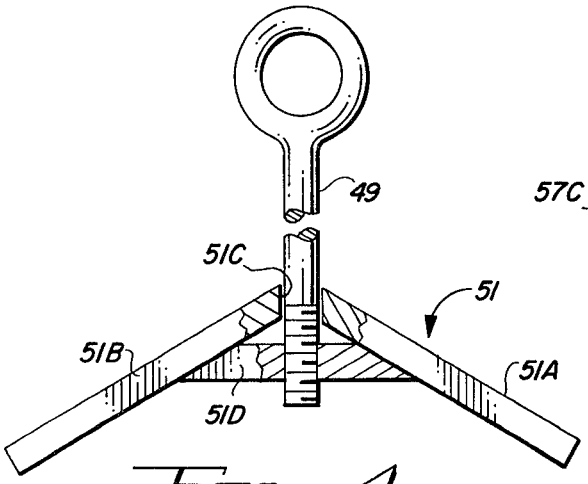
FIG. 4 is an enlarged view of detail 4 of FIG. 3.
Figure 9:
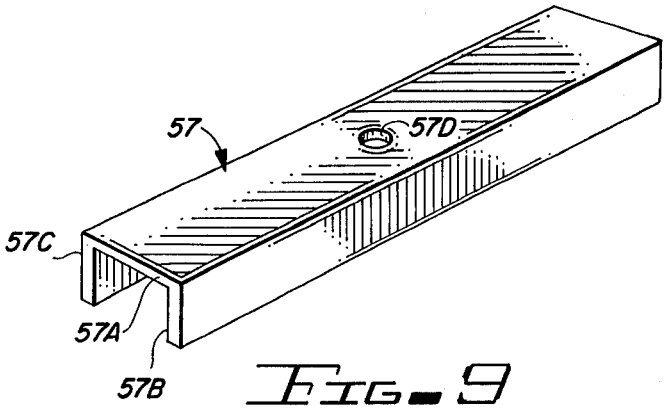
FIG. 9 is a perspective view of a spanner used in lifting the edge portions of a roof and also in lifting a floor section.
Figure 8:
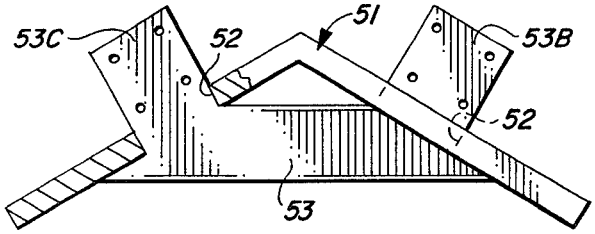
FIG. 8 is a section view of the roof peak support device of FIG. 7.

Before describing the operation of the crane to place floor section 29 for the upper story room addition to garage 5, it will be helpful to refer to FIG. 9, which shows a perspective view of a spanner 57, which is connected to support an eyelet bolt extending through the upper surface of floor section 29 at one of lift points 33A, 33B, 33C, and 33D. Other similar spanners and eyelet bolts are installed at the others of floor lift points 33A–D. It is to these eyelet bolts that the four cables 17A, 17B, 17C and 17D shown in FIG. 1C are connected. Each of the spanners 57 includes a hole 57D drilled in the center of a top plate 57A. Each spanner 57 includes two vertical sides 57C and 57B, so it can be seen that each of channels 57 consist of a similar piece of channel stock cut to an appropriate length and having a hole such as 57D drilled therein. In each of the floor lift points shown in FIG. 1C, a hole is drilled immediately adjacent to a floor joist. The floor joists are spaced at 24 inch centers, so each spanner 57 supports at least the floor joist adjacent to the corresponding lift point and the two oppositely adjacent floor joists. An eyelet bolt (such as 49 of FIG. 4) extends through the hole drilled in the surface of the floor at the lift point, through the hole 57D of the underlying spanner, and engages a nut which is threaded onto the lower end of the eyelet so that when the eyelet is lifted, the spanner 57 is lifted, evenly distributing the lifting forces on least three floor joists. Small nail holes, (not shown) are provided in plate 57A of each spanner 57, and a few double-headed nails are used to temporarily attach it to the bottom of floor section 29 for convenience.

Precisely the same approach is used for providing eyelets for lift points 21A, 21B, 21C and 21E of the previously described roof section shown in FIG. 2. However, for convenience, the spanners such as 57 are not shown in FIG. 3; an ample understanding of their function in lifting garage roof 9 should be obtained from the foregoing discussion with reference to floor section 29.

Returning now to FIG. 1C, the crane operator lifts the preconstructed floor section 29 from the ground adjacent to garage 5, raises floor section 29 upward to a height slightly above the upper edges of the walls 35 of garage 5, and then swings floor section 29 carefully over the garage region. Several workers guide floor section 29 in an aligned fashion as the crane operator slowly lowers floor section 29 onto the upper wall section 35 of garage 5. The hooked ends of the support cables are disengaged from the various eyelets and are removed by the crane operator. The spanners 57 and eyelets associated therewith are removed, and the floor section 29 is permanently attached, for example, by use of nailing straps, to the supporting walls.

It will be appreciated that in a typical residential structure, the upper wall surfaces such as upper edges 35 of the walls of garage 5, are not perfectly aligned. It is usually convenient for the construction workers to carefully measure the dimensions needed for floor section 29, if it is to fit accurately. Therefore, it usually will be convenient for the construction workers to construct floor section 29 (at ground level) right at the site of the residence being remodeled before garage roof 9 is removed therefrom.

Once floor section 29 has been installed, it is desirable to get the rest of the room addition installed as quickly as possible so that bad weather will not damage the unfinished surface of floor section 29 and there will be no leakage of water into the interior of the underlying room, especially if it happens to be some portion of the residence other than the garage. To accomplish this, the wall sections of the room additions also normally are preconstructed at the ground level of the residence site before garage roof 9 is removed.

Referring to FIG. 1D, the wall sections such as 37A, 37B, 37C and 37D are also positioned using the crane and appropriate cables, such as cables 39A and 39B, attached to hoist bar 23. The wall sections can be installed by means of the crane either with or without the exterior siding attached, although normally it will be advantageous to have attached the exterior siding to such wall panels before garage roof 9 is removed. For convenience of illustration, in FIG. 1D three of the wall sections are illustrated with siding already attached thereto, while wall section 37C does not have the exterior siding attached thereto. Brackets such as 41, shown in FIGS. 5 and 6, easily can be utilized to attach the cables to the upper beams of the wall sections, regardless of whether the exterior siding has been attached thereto. Each of the brackets 41 includes a channel member having a vertical back plate 41B and top and bottom plates 41A and 41C. A tab 41D having a hook receiving hole 41E therein is rigidly attached to the top plate 41A. The spacing between top plate 41A and bottom plate 41C is equal to the thickness of a typical "2×4" beam such as 43, which serves as the load bearing member which subsequently supports garage roof 9. FIG. 6 simply shows a side view of bracket 41 as it engages 2×4 beam 43 in order to facilitate hoisting of wall section 47E.

The individual wall sections are positioned around the periphery of floor section 21 and are nailed thereto in a conventional fashion. The corners of the various wall sections are connected together in a conventional manner. Next, the cables associated with the crane are again attached to the various eyelet bolts still attached to roof section 9, as shown in FIG. 2. The crane operator then lifts roof section 9 to a level above the upper edges of the now-installed wall sections 37A–37D, positions roof section 9 over the installed wall sections, and gradually lowers it in a direction indicated by arrow 55 in FIG. 1E. As before, the workers aid in aligning roof section 9 with the upper edges of the wall sections until it has been lowered to the point where roof section 9 rests on the upper edges of the wall sections. The various cables are disengaged from the eyelet bolts, and the crane is removed, as it is no longer needed in the operation. The eyelet bolts all are removed, as are the spanners 57 and peak spanner 51. Roof section 9 is attached by conventional methods, such as nailing straps, to the wall sections supporting it.

Next, the windows can be quickly installed in precut window openings of the wall sections, and the interior of garage 5 and the interior of the new upper story room addition then are completely sealed from outside weather.

In accordance with my experience in practicing the above method up to now, the entire above-described procedure of removing the original roof section 9, installing floor section 29 and wall sections 37A–37D and reinstalling roof section 9 can usually be accomplished in one day. This is a great improvement over previous techniques for installing second story room additions on residences. Substantially less labor is required because the floor section 29 and wall sections 37A–37D initially can be constructed at ground level, avoiding the need to carry all of the component parts up the ladders, and also avoiding the inconvenience of working at elevated heights. The labor and material that would ordinarily be required for constructing a new roof for the second story addition has been avoided. Finally, the usually lengthy exposure of the interior portions of the house and the interior of the new upper story to potential bad weather is greatly reduced, since my technique avoids exposure of the interior of a portion of the residence while the floor section, wall sections, and roof sections are being constructed.

Figure 10:
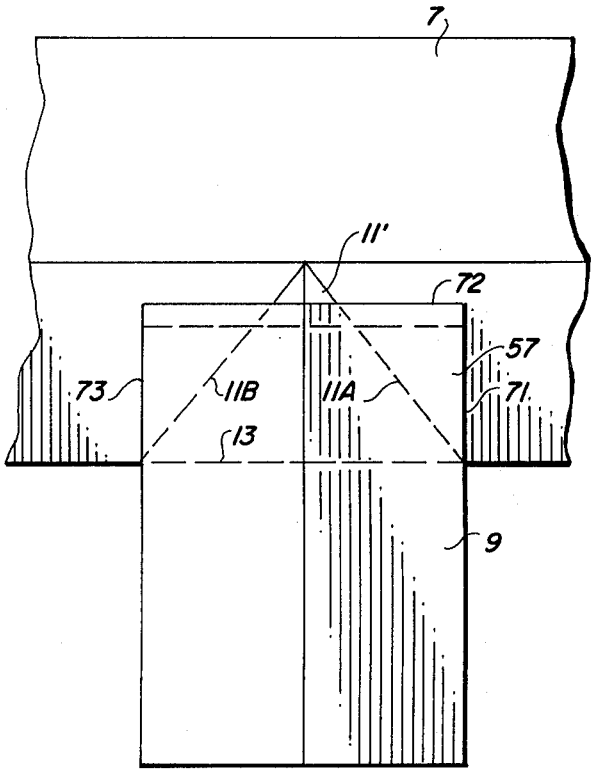
FIG. 10 is a plan view useful in explaining an alternate scheme for adding a room to the residence of FIG. 1A.

Although the above described method completely encloses the interior of residence 5 and also the interior of the new upper story room addition, an overhang structure, designated by reference numeral 57 in FIG. 10, is required, since the original roof section 9 was severed from the main roof 7 along the edge of roof section 11 (FIG. 1A) against which wall section 37D (FIG. 1D) now abuts. Overhang roof section 57 preferably is preconstructed on the ground adjacent to residence 1 and is lifted by means of the crane to the position shown in FIG. 10 and is attached to the abutting end of roof section 9.

As also shown in FIG. 10, the upper story room addition could have been made larger by extending that room further into the portion of the house covered by main roof section 7, as indicated in FIGS. 1A–E. In FIG. 10, lines 71, 72 and 73 designate portions of main roof section 7 which would have to have been removed in order to accomplish this. Floor section 29 then could have been made correspondingly longer and wall sections 37B and 37E could have been made correspondingly longer. In this event, the originally removed roof section 9 would have covered only a portion of the room addition, and a supplemental roof section would have to be constructed and lifted by the crane and positioned over the remaining portion of the upper story room addition, and the overhang area.

While the invention has been described with reference to several particular embodiments thereof, those skilled in the art will be able to make various modifications to the disclosed method and associated apparatus without departing from the true spirit and scope of the invention. For example, additional rafter support elements could be provided to facilitate lifting of arched roof structures. In certain instances, the portion of the original roof covering the portion of the house on which the second story addition is required may not be re-usable as the roof of the second addition. In this case, such portion of the original roof can be removed or torn off in the most expedient fashion, either piece by piece or by severing it, installing the roof lifting eyelet apparatus and removing it with a crane. In either event, the needed roof section for the second story addition can be completely constructed at ground level on the site at the site of the residence, the eyelet lifting apparatus can be installed as previously explained, and the newly constructed roof section then can be lifted by means of the crane and positioned on top of the walls of the second story addition in the manner previously described.

I claim:

1. A method for making a second story addition on a pre-existing residence, said method comprising the steps of:

(a) severing a first roof section that includes a finished ceiling from the remaining portion of the roof of said residence and also severing said first roof section from the walls of a first section of said residence;

(b) installing peak spanner means inside said first roof section for distributing lifting forces to at least most of the trusses or rafters of said first roof section and installing a plurality of tension elements to transmit lifting forces from respective ones of a plurality of cables to said peak spanner means, said peak spanner means including an elongated bar having a cross-sectional shape of an inverted V with an angle that matches the angle between truss chords of said first roof section, said peak spanner means including a plurality of tabs for supporting said elongated bar, said installing of said peak spanner means including pressing said elongated bar upward against the inner peak portion of said first roof section and nailing or otherwise attaching said tabs to truss chords of said first roof section, said method including drilling holes through the peak portion of said roof, extending said tension elements through said holes and attaching them to said spanner means;

(c) connecting a plurality of cables supported by a crane to said tension elements and to a plurality of lift points of said roof substantially spaced from the peak of said first roof section;

(d) operating said crane to lift said first roof section away from said residence and put said first roof section on the ground near said residence, said remaining portion of said roof and the walls of said residence all remaining in place;

(e) connecting a plurality of cables supported by said crane to a pre-constructed floor section at a plurality of lift points, respectively, of said pre-constructed floor section;

(f) operating said crane to lift said pre-constructed floor section, align it with said walls of said first section of said residence, and placing said preconstructed floor section on said walls;

(g) operating said crane to lift a plurality of pre-constructed walls sections with said pre-constructed floor section, and attaching said pre-constructed wall sections to said pre-constructed floor section;

(h) repeating step (c) to connect the plurality of cables to said first roof section on the ground; and (i) operating said crane to lift said first roof section, aligning it with the tops of said wall sections, placing said first roof section on the tops of said wall sections, and attaching it to said wall sections, whereby said first roof section can be removed from said residence, said preconstructed floor section and said pre-constructed wall sections can be installed on said residence and said first roof section can be reinstalled on said residence, within a single day.

2. The method of claim 1 including constructing said floor section and said wall sections at ground level near said residence before removing said first roof section from said first section of said residence.

3. The method of claim 2 including the step of constructing a second roof section and attaching it to said first roof section to extend said first roof section.

4. The method of claim 3 wherein said construction of said second roof section is done at ground level and said attaching of said second roof section to said first roof section is done after step (h), said crane being used to position said second roof section adjacent to said first roof section.

5. The method of claim 3 including installing a plurality of spanners under said floor section for distributing floor lifting forces to a plurality of joists of said floor section and installing a plurality of tension elements to transmit floor lifting forces from predetermined ones of said cables to predetermined ones of those tension elements.

6. The method of claim 3 wherein all of said tension elements include eyelet bolts.

* * * * *